United States Patent [19]

Kanamaru et al.

[11] Patent Number: 4,653,305

[45] Date of Patent: Mar. 31, 1987

[54] APPARATUS FOR FORMING METALLIC ARTICLE BY COLD EXTRUSION

[75] Inventors: Hisanobu Kanamaru, Katsuta; Susumu Aoyama, Chiba; Tsutomu Koike, Ibaraki, all of Japan

[73] Assignees: Hitachi, Ltd., Tokyo; M. H. Center, Ltd., Saitama, both of Japan

[21] Appl. No.: 649,295

[22] Filed: Sep. 11, 1984

[30] Foreign Application Priority Data

Sep. 13, 1983 [JP] Japan ..... 58-168974

[51] Int. Cl.[4] ..... B21D 22/00

[52] U.S. Cl. ..... 72/343; 72/265; 72/370; 72/466; 72/467

[58] Field of Search ..... 72/265, 268, 465, 466, 72/467, 370

[56] References Cited

U.S. PATENT DOCUMENTS

| | | | |
|---|---|---|---|
| 2,932,889 | 4/1960 | Kritscher | 72/343 |
| 3,165,199 | 1/1965 | Tlaker | 72/343 |
| 3,213,664 | 10/1965 | Putetti et al. | 72/343 |
| 3,261,196 | 7/1966 | Bradlee et al. | 72/343 |
| 3,564,894 | 2/1971 | Sharon | 72/343 |
| 3,837,205 | 9/1974 | Simon | 72/260 |
| 4,038,860 | 8/1977 | Kanamaru et al. | 72/358 |
| 4,509,353 | 4/1985 | Ike et al. | 72/343 |

*Primary Examiner*—Nicholas P. Godici
*Assistant Examiner*—Jerry Kearns
*Attorney, Agent, or Firm*—Antonelli, Terry & Wands

[57] ABSTRACT

A method and apparatus for cold working a metallic blank having a central hole into a substantially annular or cylindrical article such as an internally and or externally toothed gear, with the method including forcibly inserting a hollow metallic blank at a normal temperature into a die cavity formed between a mandrel placed on a fixed base and a die concentrically surrounding the mandrel so that the blank is plastically deformed between the mandrel and the die; forcibly inserting a subsequent hollow metallic blank into the die cavity while the relative position between the mandrel, the die and the first blank being plastically deformed therebetween is kept unchanged; and urging the subsequent blank against the first blank to extrude the first blank forwardly out of the die whereby the first-said blank is formed into a tubular article.

6 Claims, 20 Drawing Figures

APPARATUS FOR FORMING METALLIC ARTICLE BY COLD EXTRUSION

BACKGROUND OF THE INVENTION

The present invention relates to method of and apparatus for forming metallic articles by cold extrusion, and, more particularly, to cold extrusion method and apparatus suitable for consecutively producing annular metallic articles from annular metallic blanks.

There are two types of extrusion-forging methods which have been used conventionally for producing substantially annular metallic articles such as bushings, gears and so forth by plastic work from annular blanks having central holes therein.

In, for example, U.S. Pat. No. 4,038,860, a metallic blank, which has been suitably sized and shaped, is forced by a punch into a cavity formed between a die and a mandrel and a plastic flow of the blank material is caused thereby filling the cavity. Then, the punch and the mandrel are withdrawn and an article thus formed or molded is pushed out of the die to the same side as the the punch by knock-out pins. Thus, in this known method, the shaped product can be taken out only by being knocked out towards the blank inlet side. This means that this method cannot be applied in a case where the outside diameter of the product is greater than that of the blank. In addition, this method is not able to provide sufficiently high precision in the formation of the shaped product. Furthermore, the fact that the product is unable to possess greater diameter than the blank means that products of different sizes require blanks of corresponding sizes. In other words, it is not possible to make common use of blanks of the same size for products of different sizes. It is often experienced that a portion of a blank remains outside the die when the blank is pressed into the die cavity. Such a portion has to be removed after the cold working by taking an additional step resulting in disadvantages such as raised production cost, small yield and low productivity.

In, for example, U.S. Pat. No. 3,837,205, another method is proposed wherein blanks, each having a central bore, are discontinuously forced into a container and extruded in the direction of application of pressure to the blanks. In this known art, a mandrel also plays the role of an extruding punch; namely, for placing a new blank into the die cavity, the mandrel is temporarily withdrawn from a blank being cold-worked and is again inserted into the latter blank just before the commencement of pressing of the new blank.

This method also suffers from drawbacks due to the requirement for repetitional insertion and withdrawal of the mandrel. Namely, this method cannot be applied to a case where the inside diameter of the blank under the cold working is gradually increased or the case where the final product has a greater outside diameter than the blank. In addition, the shape of the mandrel is restricted inconveniently. Furthermore, in this known art, the product has to be knocked out of the blank inlet of the die, with resultant disadvantageous wear of the die and slight distortion of the product. This method, therefore, is not preferred from the view point of precision of the product. Furthermore, productivity is low and production costs high due to the difficulty encountered when taking out the product from the die and due to the necessity for a die having a complicated structure.

Accordingly, an object of the invention is to provide a cold extrusion method which makes it possible to produce, by a cold extrusion from an annular blank, an accurately molded annular article having an outside diameter smaller or greater than that of the annular blank.

Another object of the invention is to provide a cold extrusion method in which a steady extrusion is effected over the entire part of the material under extrusion by the generation of a back pressure in the die, thereby ensuring high precision both in size and shape.

Still another object of the invention is to provide a cold extrusion method in which the material is deformed beyond the limit of the free elongation thereof due to a three-dimensional compression effected with the assistance of the back pressure.

A further object of the invention is to provide a cold extrusion apparatus constructed to achieve high productivity.

According to one feature of the invention, a method of plastically working metallic articles is provided which comprises the steps of: forcibly inserting a hollow metallic blank, at a normal temperature, into a die cavity formed between a mandrel placed on a fixed base and a die concentrically surrounding the mandrel so that the blank is plastically deformed between the mandrel and the die; forcibly inserting a subsequent hollow metallic blank into the die cavity while the relative position between the mandrel, the die and the first said blank being plastically deformed therebetween is maintained unchanged; and urging the subsequent blank against the first-said blank being deformed to extrude the first-said blank forwardly out of the die whereby the first-said blank is formed into a tubular article.

According to another feature of the invention, an apparatus for plastically working metallic articles is provided which comprises: a container for constraining the outside diameter of a metallic blank; a die connected to the lower end of the container and adapted to determine the outside diameter of an article to be obtained; a mandrel placed on a fixed base and disposed in the container and the die substantially concentrically therewith to cooperate therewith to define a die cavity, the mandrel being adapted to constrain the inner diameter of the blank; a punch fixed to a slider and movable therewith to force the blank into the die cavity so that a preceding blank in the die cavity is extruded downwardly therefrom; the die, the mandrel and the container being momentarily united together by a blank in the die cavity to form a momentary unit; and means for lifting the momentary unit following up an upward movement of the slider and thus the punch.

These and other objects, features and advantages of the invention will become clear from the following description with reference to the accompanying drawings.

DETAILED DESCRIPTION

Preferred embodiments of the invention will be described hereinunder with reference to the accompanying drawings.

Figure 1:
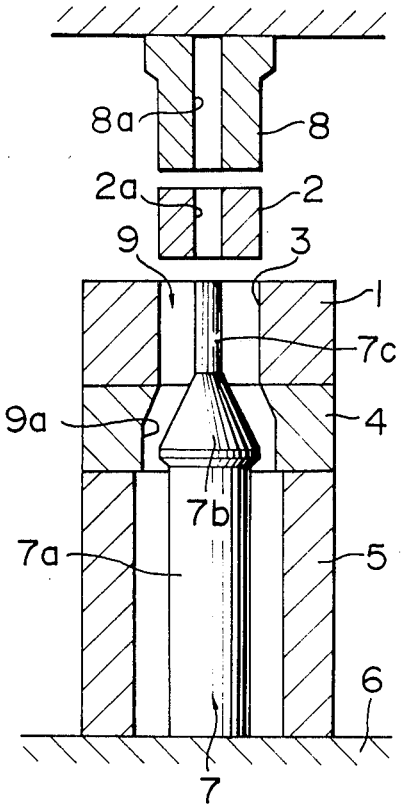
FIG. 1 is a schematic sectional view of an embodiment of a cold extrusion apparatus used to carry out the method of the invention.

Referring now to the drawings wherein like reference numerals are used throughout the various views to designate like parts and, more particularly, to FIG. 1, according to this figure, a cold extrusion apparatus has a container 1 having an inner configuration which constrains the outer configuration of a cylindrical metallic blank 2. The container 1 has an axial through-bore 3 for receiving the metallic blank 2. The apparatus also has a die 4 which determines the outer diameter of the product. The container 1 is carried by the die 4 which, in turn, is mounted on a die anvil 5 supported by a fixed base 6. The connection between the container 1 and the die 4, as well as the connection between the die 4 and the die anvil 5, is achieved by a socket and spigot joint. The die 4 has an inside diameter which is slightly greater than that of the container 1.

The cold extrusion apparatus further has a mandrel 7 disposed in the container 1 and the die 4 coaxially therewith. The mandrel 7 is so shaped and sized so as to determine the inside diameter of the product. More specifically, the mandrel 7 is composed of a conical shaping portion 7*b* which diverges downwardly to gradually enlarge the inside diameter of the blank to the final size, a leg portion 7*a* carrying the shaping portion 7*b* and supported on the base 6, and a guide rod portion 7*c* adapted to be received by the central bore of the blank 2. The apparatus further has a punch 8 adapted to force the blank 2 into an annular die cavity 9 defined between the container 1 and the mandrel 7 and between the die 4 and the mandrel 7. The punch 8 is sized for insertion into the bore 3 in the container 1 and is provided with a central bore 8*a* adapted to receive the rod portion 7*c* of the rod 7.

An explanation will be made hereinunder with specific reference to FIGS. 2A to 2D as to how the metallic blank 2 is cold-worked by the above-described cold extrusion apparatus into the desired product.

Figure 2A:
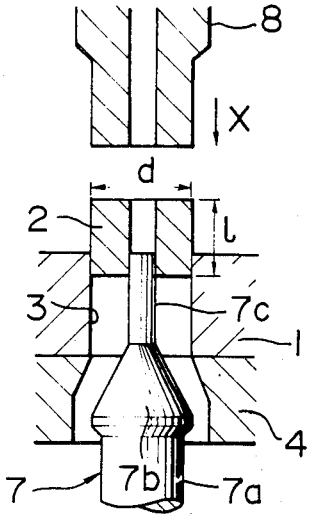
FIG. 2A to 2D are sectional views of a blank in successive steps of a cold extrusion process.
Figure 2B:
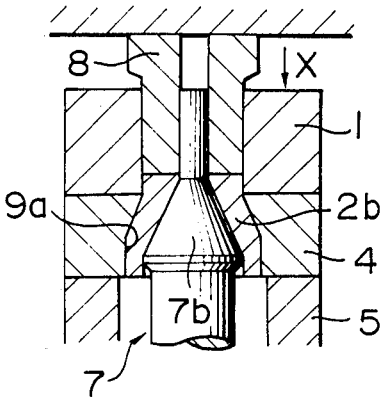

As the first step of operation, a metallic blank 2 is placed in the through-bore 3 of the container 1, as shown in FIG. 2A. The blank 2 has a length of "l" and an outside diameter of "d" and is provided with a central bore of a diameter substantially equal to the outside diameter of the rod portion 7*c* of the mandrel 7. Subsequently, the punch 8 makes a complete stroke downwardly in the direction of the arrow X so as to force the metallic blank 2 into the die cavity 9 as shown in FIG. 2B. Since the inner and outer peripheries of the metallic blank 2 are constrained by the shaping portion 7*b* of the mandrel 7 and the wall of the die 4, the axial pressing force exerted by the punch 8 to the blank 2 produces radially outward and inward forces acting on the blank 2. Consequently, the blank 2 is compressed three-dimensionally to cause a plastic flow of the material thereof to fill the portion 9*a* of the die cavity defined between the die 4 and the shaping portion 7*b* of the mandrel 7. As a result, the blank 2 is plastically deformed to have a configuration conforming to the die cavity portion 9*a* so that it has an increased axial length and enlarged inside and outside diameters.

Figure 2C:
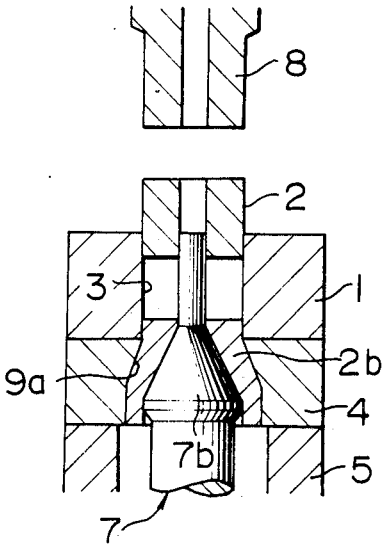
Figure 2D:
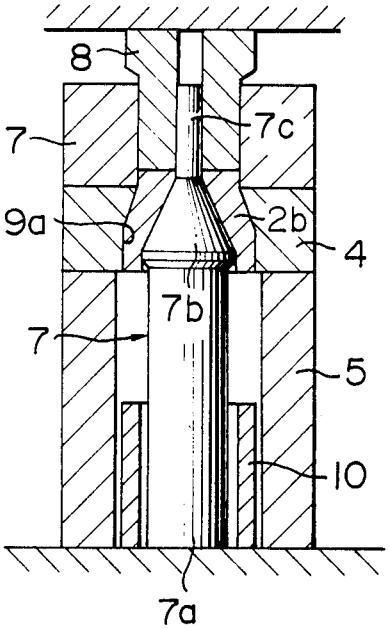

After the completion of the pressing of the metallic blank 2 by the full-stroking of the punch 8, the punch 8 is withdrawn in the direction opposite to the arrow X and the next metallic blank 2 is placed in the through-bore 3 of the container 3, as shown in FIG. 2C. The punch 8 is then driven again to effect the cold plastic work on this new metallic blank 2. Consequently, this new metallic blank is forcibly deformed plastically to fill the portion 9*a* of the die cavity 9 while the first or preceding blank 2 is forced out from the die cavity portion 9*a* by the second or subsequent metallic blank 2, as shown in FIG. 2D. In this state, the preceding metallic blank 2 has been cold-worked into the final shape and size, i.e., into a cylindrical form 10 having an increased axial length and enlarged inside and outside diameters. This product 10 rests on the base 6 so as to surround the leg portion 7*a* of the mandrel 7.

By conducting this operation cyclically for successive metallic blanks 2, it is possible to consecutively produce cold-extruded products 10.

As shown in FIGS. 3 to 5*a* plurality of guide rods 11 are provided which protrude uprightly from the base 6. The die anvil 5 is provided at its upper portion with a flange 5*a* having bores loosely receiving corresponding guide rods 11. Coiled springs 12 extend around the guide rods 12 to act between the lower face of the flange 5*a* and the base 6 so that the die anvil 5 carrying the die 4 and the container 1 are normally biased upwardly to maintain the lower end of the die anvil 5 spaced from the base 6 to provide an access space 13 by which the product 10 is made accessible and thus may be taken out as desired. The mandrel 7 has a cylindrical leg portion 7*a* having an outside diameter smaller than the inside diameter of the product 10. This leg portion 7*a* is provided at the upper end thereof with a land portion 7*d*, which determines the inside diameter of the product 10 in cooperation with the die 4, and a downwardly diverging tapered shaping portion 7*b* which also cooperates with the die 4 to progressively enlarge the inside diameter of the blank 2 under processing. A rod portion 7*c* sized and positioned to fit in the central bore 2*a* of the blank 2 is formed integrally with the shaping portion 7*b* so as to extend upright there- from.

This cold extrusion apparatus has a slider 14 disposed vertically movably above the container 1. The slider 14 is provided with a punch 8 which is adapted to force the metallic blank 2 into the die cavity 9 to cause a plastic deformation of the material of the blank 2. A pressing means 15, formed by resiliently compressive members, such as rubber blocks, are secured to the lower face of the slider 14 confronting the container 1. The pressing means 15 is intended to prevent the die 4 from springing upward by a reaction force produced by the blank 2 when the same is plastically deformed in the die cavity 9 by the force exerted by the punch 8.

The operation of this apparatus is as follows. For an easier understanding of the operation, it is assumed here that the cold extrusion apparatus assumes the position shown in FIG. 3 in which a metallic blank 2 has been forced into the die cavity 9 between the die 4 and the land and shaping portions 7*d* and, 7*b* of the mandrel 7 by the action of the punch 8 and expanded radially and axially within the die cavity 9 to form a semi formed product or preform 2*b*. In this state, therefore, the mandrel 7 is momentarily united or fixed to the assembly constituted by the container 1 and the die 4. In addition, the die anvil 5 has been raised with the momentary unit to the upper stroke end by the force of the coiled springs 12.

Figure 3:
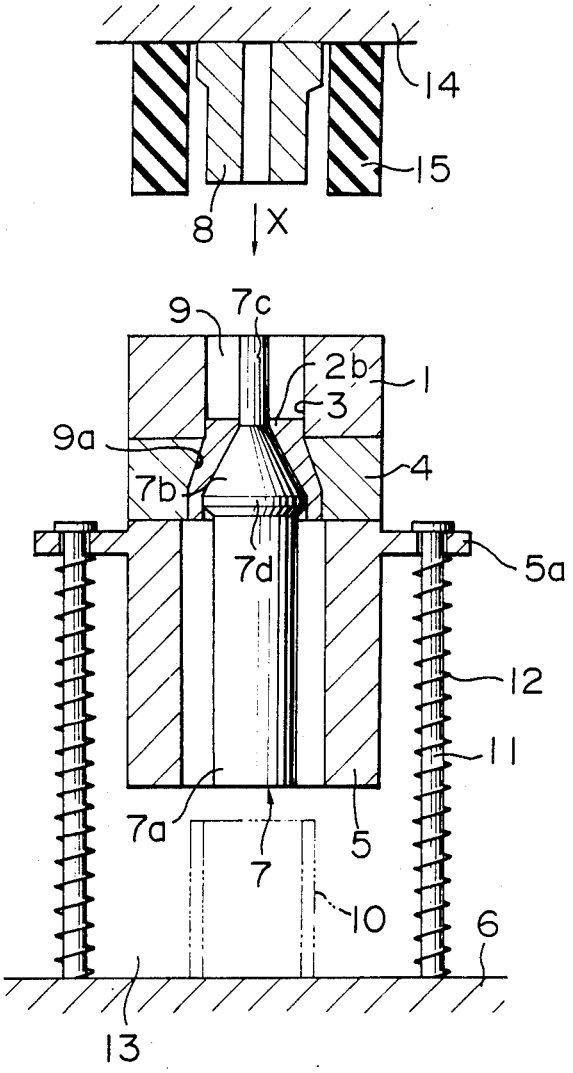
FIG. 3 is a longitudinal sectional view of a cold extrusion apparatus in its position in which a product is taken out of a die cavity.
Figure 5:
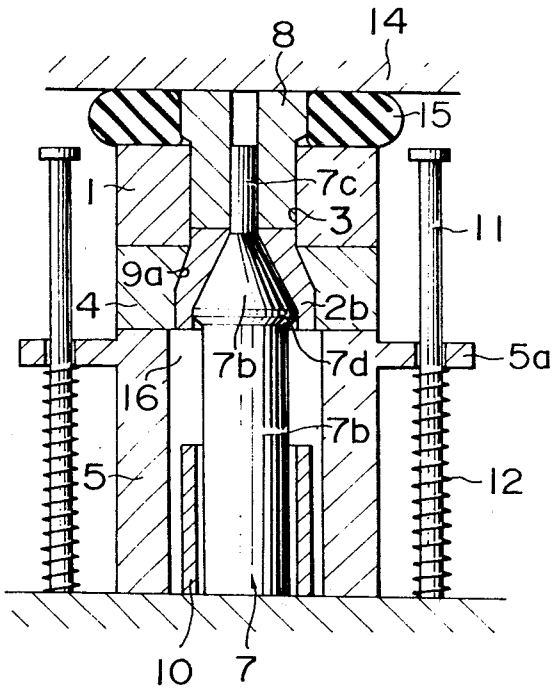
FIGS. 4 and 5 are longitudinal sectional views of the cold extrusion apparatus in different steps of an extrusion operation.
Figure 4:
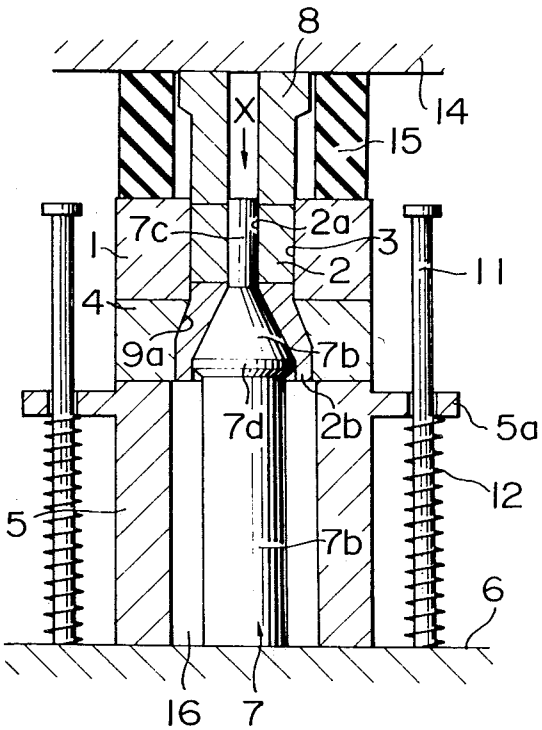

Now, a succeeding metallic blank 2 (not shown in FIG. 3) is placed in the bore 3 of the container 1 and the slider 14 is moved in the direction of the arrow X as shown in FIG. 3. As a result, the pressing means 15, provided on the slider 14, is pressed onto the upper end surface of the container 1 so as to downwardly urge the integral body constituted by the container 1, die 4, die anvil 5, preform 2*b* and the mandrel 7 against the force of the coiled springs 12 until the die anvil 5 is engaged with and stopped by the base 1, as shown in FIG. 4. A further stroking of the slider 14 causes a compression of the pressing means 15 so that the assembly constituted by the container 1, die 4 and the die anvil 5 is pressed strongly between the pressing means 15 and the base 1. At the same time, the punch 18, integral with the slider 14, forces the metallic blank 2 into the die cavity 9 formed between the mandrel 7 and the container 1. As the punch 8 is driven into the bore 3 in the container 1 to the lower stroke end, the of the metallic blank 2 plastically flows to fill the portion 9*a* of the die cavity 9. Consequently, the metallic blank 2 is expanded radially outwardly while being stretched axially. In this state, the lower end portion of the metallic blank 2 has been shaped into its final size, with the inside diameter thereof determined by the land portion 7*d*, so that the blank 2 is now formed into a new preform, as shown in FIG. 5. Meanwhile, the preceding preform 2*b*, which has been in the die cavity 9 within the die 4 as shown in FIGS. 3 and 4, is extruded through the annular gap between the land portion 7*d* of the mandrel 7 and the opposing wall of the die 4, so that a cylindrical product 10 having a constant cross-section drops onto the base 6 through an annular passage or space 16, as shown in FIG. 5.

In order to prepare for the next extrusion cycle, the slider 14 is moved upwardly away from the container so that the container 1 is freed from the downward pressure which has been exerted by the pressing means 15. As a result, the assembly, constituted by the container 1, die 4, and the die anvil 5 as well as the mandrel 7 integrated with the assembly through the new preform 2*b*, is moved upwardly by the force of the coiled springs 12 following up the upward movement of the slider 14. Consequently, the product 10 left on the base 6 becomes accessible for an easy transfer through the access space 13 shown in FIG. 3 as being formed between the lower end of the die anvil 5 and the base 6.

As described, metallic blanks 2 are successively forced into the die cavity 9 between the mandrel 7 and opposing walls of the container 1 and the die 4 by the punch 8, and products 10 are successively extruded into the space 16.

It will be seen that cylindrical products 10 are successively cold-extruded by quite a simple operation and can be easily removed through the access space 13 which is formed each time the assembly including the container 1, die 4 and the mandrel 7 is moved upwardly following the upward movement of the slider 14.

Although an embodiment suitable for producing cylindrical products has been described by way of example, it will be understood that the same embodiment can easily be modified for the cold extrusion of products each having serration or spline in one or both peripheral surfaces, or products having a specific outer configuration, such as spur gears. In the above described embodiment, coiled springs 12 are used for upwardly urging the assembly constituted by the container 1, die 4, die anvil 5, preform 2*b* and the mandrel 7. This, however, is not exclusive and the coiled springs 12 may be substituted by equivalent means, such as pneumatic cylinders, adapted to urge the assembly as a whole upwardly following the movement of the slider 14. The pressing means 15 is not essential and may be omitted if no reactional force, which would push the container 1 and the die 4 upwardly, is produced.

Figure 6:
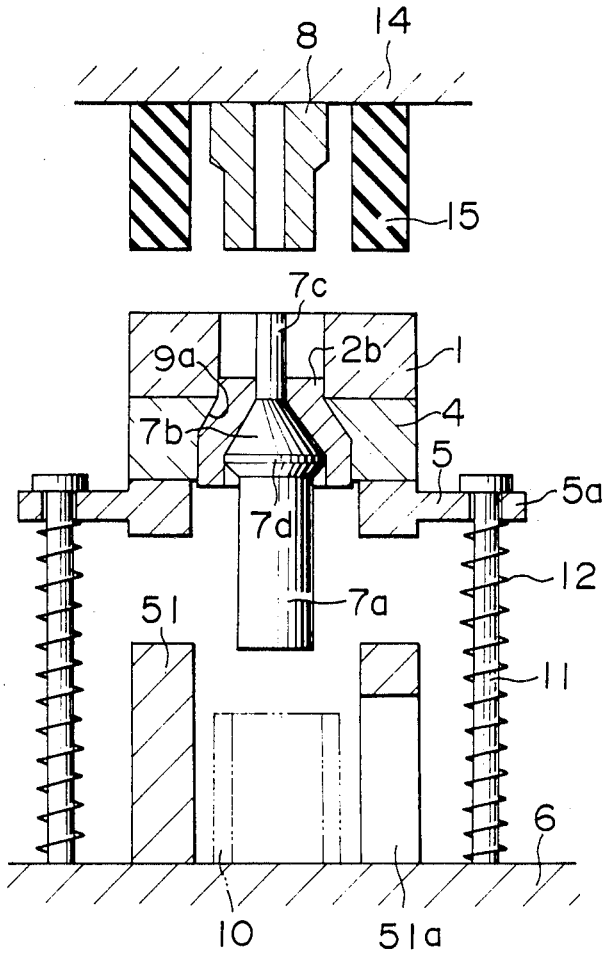
FIGS. 6 and 7 are longitudinal sectional views of other embodiments of the cold extrusion apparatus of the invention.

In the embodiment of FIG. 6 the die anvil 5 is divided into two sections, namely, an upper section having the flange 5*a* and a lower section 51 which is provided with a product access opening 51*a* which provides access to the formed product. Therefore, in the embodiment of FIG. 6, the product 10 can be taken out of the apparatus without lifting of the whole portion of the die anvil 5.

Figure 7:
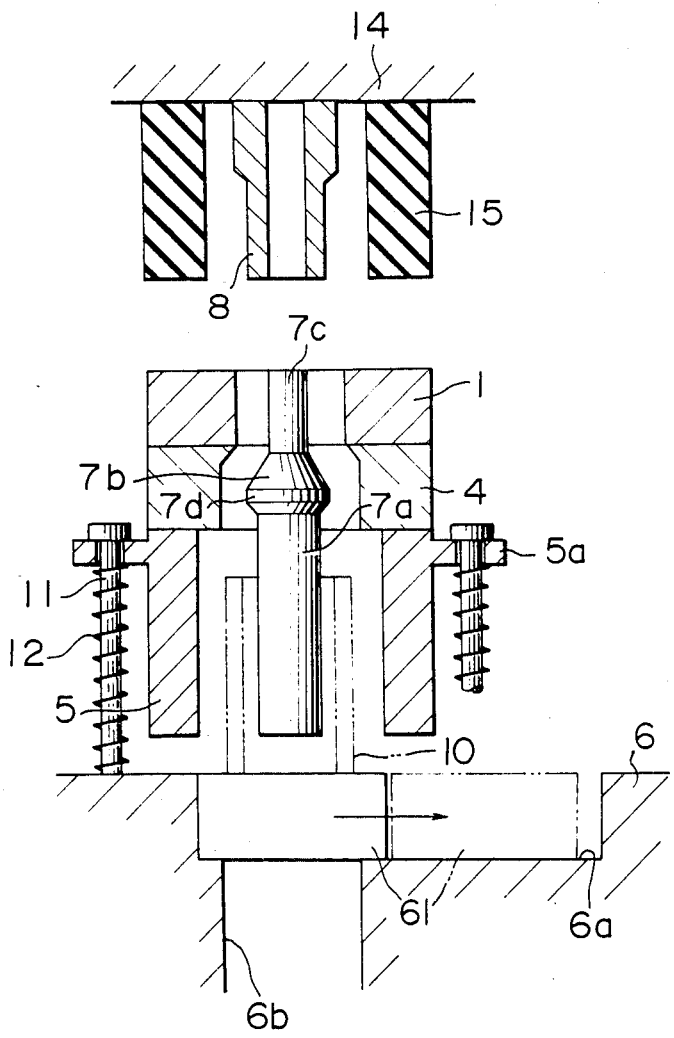

In the embodiment of FIG. 7 shows a special construction of the base 6 is provided. More specifically, the base 6 is provided with a recess 6*a*, in which is disposed a movable base plate 61 which has a width greater than the diameter of the product 10. A drop hole 6*b* of a diameter smaller than the width of the movable base plate 61 and greater than the outside diameter of the product 10 is formed in the base 6 under the mandrel 7 substantially coaxially therewith so as to be selectively covered by the movable base plate 61. In the embodiment of FIG. 7, it is possible to take out the product in such a manner that vertical movement of the assembly, constituted by the die anvil 5, die 4 and the container 1, can be minimized.

The embodiments described hereinbefore offer the following advantages.

(1) Products of different sizes and shapes can be produced from metallic blanks of a given shape and size, so that the process for preparation of the blanks can be rationalized advantageously.

(2) It is possible to produce an annular or cylindrical product having inside and outside diameters greater than the diameter of the through-bore formed in the container. Therefore, the pressing area of the punch can be made small regardless of the inside and outside diameters of the final product, so that the blank can be plastically deformed by a smaller force than in the conventional apparatus.

(3) Since the outside diameter of the blank and the size of the central bore thereof can be minimized, the capacities of the installations employed in the steps of blank preparation such as cutting, preforming and boring can be advantageously decreased.

(4) In the case where the inside and outside diameters of a blank are both increased, it is possible to constantly maintain the material under three-dimensional compression by providing a condition wherein the blank is axially elongated by the cooperation of the die and the mandrel. By so doing, it is possible to increase the inside and outside diameters of a blank beyond the free elongation limit thereof without any fear of cracking even when the material of the blank is rather fragile and only a small degree of free elongation is allowed.

(5) It is possible to lubricate the central bore in the blank. In addition, the cold working can be completed by a single uni-directional passage through the die. Consequently, the wear and damage of the die can be minimized to ensure a longer life of the die.

(6) The diameter of the central bore of the blank can be decreased irrespective of the inside diameter of the final product, so that the yield of the preparation of blanks can be appreciably improved.

(7) In the conventional cold extrusion apparatus of the kind described, it is necessary to provide an approaching section in the transient section between the container which receives the blank and the die portion which determines the outer configuration of the product. In the cold extrusion apparatus of the described embodiment, however, such an approach is eliminated and the die is required only to have a two-dimensional shape corresponding to the cross-section of the product. Consequently, the production of the die can be advantageously simplified. The same applies also to the mandrel which determines the inner configuration of the product.

(8) Since the product can be extruded to the final shape and size by a single uni-directional passage through the die, it is possible to maintain a constant condition for extrusion. This in turn permits easy control of the elastic deformation of the die to thereby ensure the high precision of the work. For the same reason, it is possible to obtain a constant cross-section of the product along the entire length of each product and to enhance productivity.

As has been stated, the invention effectively suppresses the wear of the mold and prolongs the life of the die, while ensuring the high precision of the product in terms of both size and shape. This is entirely due to the fact that the metallic blanks are charged successively into the die-cavity and shaped into the final products by a single uni-directional passage through the die for each blank. In addition, since the assembly consisting of the container,die, die anvil and the mandrel is lifted following up the upward movement of the slider so as to form an access space permitting easy transfer of the product from the cold extrusion apparatus. Consequently, productivity is enhanced and the production cost can be reduced advantageously.

Figure 8:
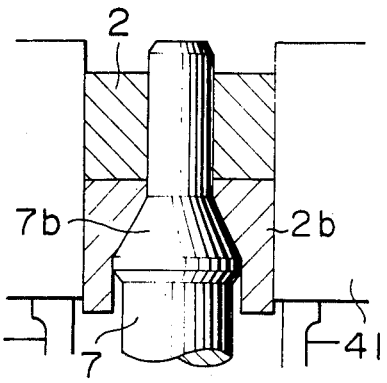
FIGS. 8 to 17 are schematic illustrations of further embodiments of the cold extrusion apparatus in various speps of operation.

FIG. 8 shows an arrangement which is suitable for effecting the cold extrusion such that the blank is axially elongated while the inside diameter thereof is increased progressively. To this end, the die 41 is formed integrally with the container from the same material. Therefore, the container and the die 41 present a continuous straight inner surface along which the blank material is extruded to become the product.

Figure 9:
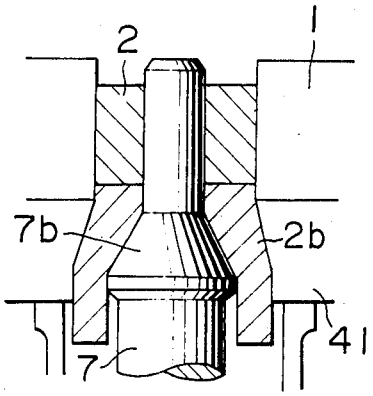

FIG. 9 shows an arrangement which is effective in the cold extrusion in which both the inside and outside diameters of the blank are increased progressively. The die 41 has an inner peripheral surface which is tapered substantially in conformity with the tapered surface of the conical shaping portion *7b* of the mandrel 7.

Figure 10:
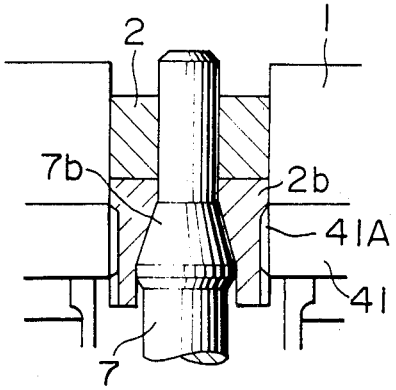

FIG. 10 shows an arrangement in which the die 41 has an inside diameter smaller than that of the container 1 and working teeth 41A for forming gear teeth or a straight spline in the outer surface of the product are formed on the inner peripheral surface of the die 41. With this arrangement, therefore, gear teeth are formed in the outer periphery of the product during the cold extrusion of the blank material.

Figure 11:
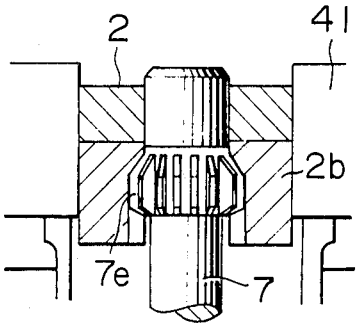

FIG. 11 shows an arrangement which is effective in the case where gear teeth are to be formed in the inner peripheral surface of a pipe to be extruded. To this end, the shaping portion of the mandrel 7 is not conical but provided with working teeth *7e*.

Figure 12:
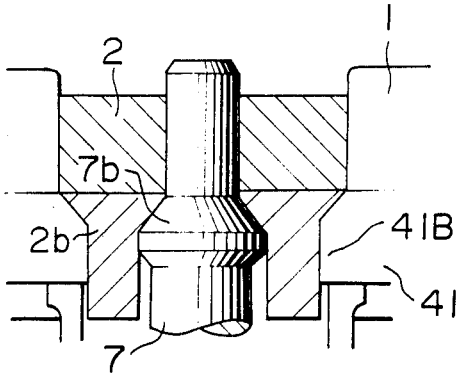

The arrangement shown in FIG. 12 is suitable for a case where the cold extrusion is effected such that the inside diameter of the blank is increased while the outside diameter is decreased. With this arrangement, an axially elongated product is obtained as in the case of the arrangement shown in FIG. 8. The die 41 is this case has a radially inwardly projecting land portion 41B which is connected to the inlet end of the die 41 by a downwardly converging tapered surface.

Figure 13:
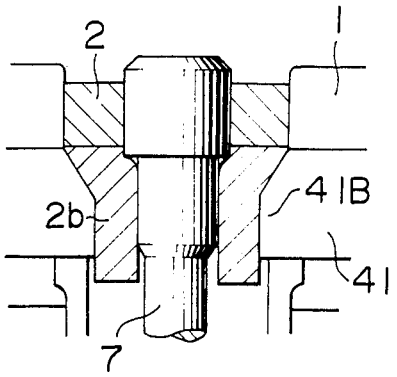

FIG. 13 shows an arrangement intended for the production of a pipe of a small diameter by decreasing both the inside and outside diameters of the metallic blank. In this case, the mandrel 7 is stepped at several portions thereof to different diameters and the inner peripheral surface of the die 41 has a radially inwardly projecting land portion 41B similar to that of the arrangement shown in FIG. 12.

Figure 14:
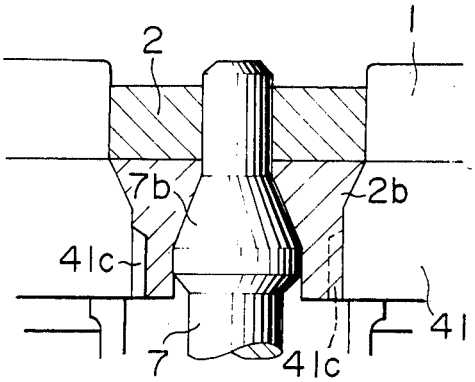

FIG. 14 shows an arrangement in which processing teeth 41*c* are formed in an inwardly projecting land on the inner peripheral surface of the die 4 in opposing relationship with the shaping portion *7b* of the mandrel 7. This arrangement is suitable for use in the case where the cold extrusion is conducted to form gear teeth in the outer peripheral surface of the product while the inside and outside diameters of the blank are increased and decreased, respectively.

Figure 15:
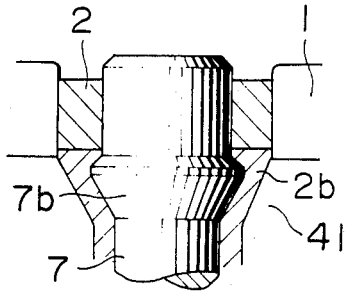

FIG. 15 shows an arrangement in which the shaping portion *7b* of the mandrel has a downwardly converging tapered surface substantially conforming with a downwardly converging tapered inner surface of the die 41. This arrangement is suitable for the production of a thin-walled pipe having a small diameter.

Figure 16:
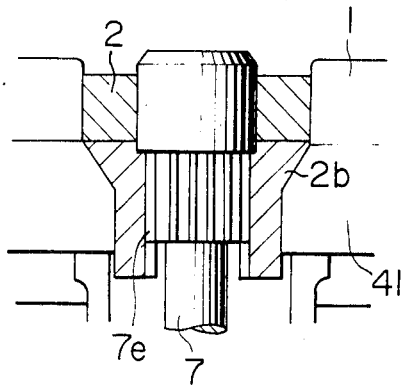

FIG. 16 shows an arrangement which is similar to that shown in FIG. 13 except that working teeth *7e* are formed on the shaping portion of the mandrel 7 in order to form gear teeth on the inner peripheral surface of the product pipe.

Figure 17:
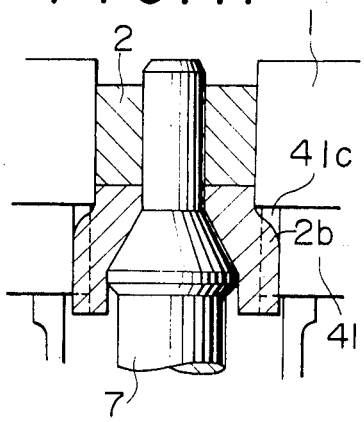

In the arrangement shown in FIG. 17, working teeth 41*c* are formed on the inner peripheral surface of the die 41 so that gear teeth are formed on the outer peripheral surface of the product while the inside and outside diameters of the blank are increased progressively.

Although, in most of the illustrated arrangements, the container and the die are formed as separate bodies, the container and the die may be formed together as a unit or integral body as in the case of the arrangement shown in FIG. 8, provided that the product to be obtained is suited to comparatively easy cold extrusion.

What is claimed is:

1. An apparatus for cold working hollow metallic blanks into hollow articles, each blank having a central through-hole, the apparatus comprising:

means for defining therein an open-topped and open-bottomed space for receiving the blanks successively and forming an outer periphery of each blank, said space defining means being movable upwardly and downwardly between a lower position and a raised and floating position;

means for guiding the upward and downward movements of said space defining means and for biasing the same toward said raised and floating position;

inner means disposed in said space coaxially therewith for forming the inner peripheral surface of each blank, said inner means cooperating with said space defining means to define therebetween an open-topped and open-bottomed forming space, said inner means being movable in an upward and downward direction between a lowered position and a raised position;

urging means disposed above said forming space and being movable in upward and downward directions;

means for drivingly moving said urging means downwardly to urge the blanks into said forming space successively so that each blank is plastically worked and extruded into a hollow article; and means for stopping the downward movements of said space defining means and said inner means at their lowered positions, respectively;

wherein when said urging means is downwardly moved by said moving means to force a blank into said forming space, said sapce defining means and said inner means are moved downwardly to their lowered positions against the force of said guiding and biasing means, such that said urging means is further moved downwardly by said moving means with said space defining means and said inner means both maintained stationary at their lowered positions to forcibly move said blank in said forming space relative to said space defining means and to said inner means whereby said blank is shaped in said forming space into a preform; and wherein said urging means is then moved upwardly by said moving means to permit said space defining means to be moved by said guiding and biasing means to said raised and floating position, the upward movement of said space defining means being transmitted to said inner means by the preform held therebetween whereby said inner means is also raised together with said space defining means by said guiding and biasing means, said urging means being again downwardly moved by said moving means to urge a succeeding blank into said forming space whereby said preform is extruded out of said forming space by said succeeding blank to form a hollow article.

2. A cold working appartus according to claim 1, wherein said space defining means comprise a hollow container, a hollow die and a hollow die anvil, and said container, die and die anvil are disposed in a coaxial relationship with respect to each other.

3. An apparatus for cold working hollow metallic blanks into hollow articles, each blank having a central through-hole, the apparatus comprising:

a container for constraining the outer diameter of each blank;

a die connected to a lower end of said container coaxially therewith and adapted to form the outer periphery of the article to be obtained;

a hollow die anvil disposed below said die substantially coaxially therewith and connected thereto;

said die anvil being movable together with said container and said die in upward and downward directions between a lower position and a raised and floating position;

means for guiding the upward and downward movements of said die anvil;

return means resiliently biasing said die anvil with said die and container thereon toward said raised and floating position;

said container, said die and said die anvil defining an open-topped and open-bottom inner space;

a mandrel disposed in said inner space coaxially therewith to form the inner periphery of the article to be obtained, said mandrel cooperating with said container and said die to define an open-topped and open-bottom die cavity communicating with said die anvil, said mandrel being movable in upward and downward directions between a lowered position and a raised position;

means for stopping the downward movement of said die anvil and said mandrel at the lower positions thereof, respectively;

a slider disposed above said container and being movable toward and away therefrom;

a punch fixed to said slider and movable thereby to force the blanks successively into said die cavity so that the blanks are successively formed and extruded into hollow articles;

wherein, when said punch is downwardly moved by said slider to force a blank into said die cavity, said die anvil with said container and said die mounted thereon is moved against the force of said return means to said lowered position of said die anvil and said mandrel is also moved to said lowered position thereof, such that said punch is further moved downwardly by said slider with sand mandrel and said die anvil are both maintained stationary at their lower positions to forcibly move said blank in said die cavity relative to said mandrel and to said container and said die whereby said blank is shaped into a preform in said die cavity; and wherein said punch is then moved upwardly by said slider to permit said die anvil to be moved upwardly together with said die and said container by said return means to said raised and flating position of said die anvil, the upward movement of said die being transmitted to said mandrel by the preform held between said mandrel and said die whereby said mandrel is also raised upwardly by said return means, said punch being again moved downwardly by said slider to urge a succeeding blank into said die cavity whereby said preform is extruded out of said die cavity by said succeeding blank to form an hollow article.

4. A cold working appartus according to claim 3, wherein said die anvil comprises upper and lower separate sections, said guiding means comprise upstanding guide rods, said return means comprise coil springs respectively extending along said guide rods, said upper section of said die anvil is movable along said guide rods and resiliently supported by said coil springs, and said lower section of said die anvil has a peripheral wall formed therein with an opening through which the article thus worked can be taken out of said die anvil.

5. A cold working apparatus according to claim 3, wherein said die has a conical inner surface and said mandrel has a conical outer surface substantially conforming to said conical die inner surface.

6. A cold working apparatus according to claim 3, wherein said mandrel has an upper larger-diameter section and a lower-smaller diameter section, said die has larger and smaller-diameter sections, and said smaller-diameter sections of said mandrel is opposed to said smaller-diameter section of said die.

* * * * *